US010067442B2

(12) United States Patent
Eto

(10) Patent No.: US 10,067,442 B2
(45) Date of Patent: Sep. 4, 2018

(54) DEVELOPER STORAGE CONTAINER WITH FLEXIBLE STIRRING PIECES CONFIGURED SO THAT AN EXTENSION OF ONE STIRRING PIECE IS ARRANGED OUTWARD OF A BASE OF AN ADJACENT STIRRING PIECE AND IMAGE FORMING APPARATUS PROVIDED WITH SAME

(71) Applicant: KYOCERA Document Solutions Inc., Osaka-shi (JP)

(72) Inventor: Daisuke Eto, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 0 days.

(21) Appl. No.: 15/672,392

(22) Filed: Aug. 9, 2017

(65) Prior Publication Data

US 2018/0046111 A1 Feb. 15, 2018

(30) Foreign Application Priority Data

Aug. 10, 2016 (JP) ..... 2016-157429

(51) Int. Cl.
*G03G 15/08* (2006.01)
*G03G 15/10* (2006.01)

(52) U.S. Cl.
CPC ..... *G03G 15/0875* (2013.01); *G03G 15/0877* (2013.01); *G03G 15/0891* (2013.01); *G03G 15/104* (2013.01)

(58) Field of Classification Search
CPC ..... G03G 15/0822; G03G 15/087; G03G 15/0877; G03G 15/0889; G03G 15/0891
USPC ..... 399/254, 262, 263
See application file for complete search history.

(56) References Cited

U.S. PATENT DOCUMENTS 8,588,661 B2 * 11/2013 Ota ..... G03G 15/0877 399/263
8,958,727 B2 * 2/2015 Hayashida et al. ..... G03G 15/0877 399/263
9,599,928 B2 * 3/2017 Maruyama ..... G03G 15/0889
2015/0063878 A1 3/2015 Torimoto

FOREIGN PATENT DOCUMENTS

JP 2001-235933 8/2001
JP 2015-45683 3/2015

* cited by examiner

*Primary Examiner* — William J Royer
(74) *Attorney, Agent, or Firm* — Gerald E. Hespos; Michael J. Porco; Matthew T. Hespos

(57) ABSTRACT

A developer storage container includes a container body having a developer discharge port, a shaft body extending in a first direction and rotatably disposed in the container body, and a stirring member to be attached to the shaft body. The stirring member is made of a flexible film-like member and stirs the developer stored in the container body by rotating according to the rotation of the shaft body. The stirring member includes an attaching portion serving as an area part for attachment to the shaft body, and a stirring piece having a base portion extending from the attaching portion toward the inner peripheral surface of the container body in a second direction perpendicular to the first direction and an extending portion extending from the base portion in a third direction intersecting with the second direction to approach the developer discharge port.

5 Claims, 11 Drawing Sheets

DEVELOPER STORAGE CONTAINER WITH FLEXIBLE STIRRING PIECES CONFIGURED SO THAT AN EXTENSION OF ONE STIRRING PIECE IS ARRANGED OUTWARD OF A BASE OF AN ADJACENT STIRRING PIECE AND IMAGE FORMING APPARATUS PROVIDED WITH SAME

INCORPORATION BY REFERENCE

This application is based on Japanese Patent Application No. 2016-157429 filed with the Japan Patent Office on Aug. 10, 2016, the contents of which are hereby incorporated by reference.

BACKGROUND

The present disclosure relates to a developer storage container for storing developer inside and an image forming apparatus provided with the same.

Conventionally, in an electrophotographic image forming apparatus, a developing process is performed by supplying developer (toner) from a developing device to an electrostatic latent image formed on a surface of a photoconductive drum serving as an image carrier. Further, the toner used in such a developing process is supplied from a developer storage container to the developing device.

There is known a developing device with a developer storage container (toner cartridge) including a toner discharge port, a housing including a toner receiving port for receiving the toner from the toner discharge port and configured to store the developer, and a stirring/conveying member configured to stir and convey the developer in the housing. In this developing device, a developer conveying ability by the stirring/conveying member is locally reduced on a side downstream of a toner receiving area equivalent to an area below the toner receiving port in the housing. In such a configuration, the developer is retained in the toner receiving area of the housing and the supply amount of the toner from the developer storage container via the toner receiving port is controlled according to the retained amount of this developer.

Further, there is known a stirring mechanism with a rotary shaft member provided inside a developer storage container (toner container) and a stirring member attached to that rotary shaft member. In this stirring mechanism, the stirring member is a film-like member having a predetermined length along an axial direction of the rotary shaft member and includes a plurality of movable pieces defined by a plurality of cuts perpendicular to the axial direction. In the stirring mechanism, toner stored in the developer storage container is stirred while each movable piece is deflected along a rotating direction by the stirring member rotating according to the rotation of the rotary shaft member.

In the above stirring mechanism, each movable piece of the stirring member extending along the axial direction of the rotary shaft member scoops up the toner stored in the developer storage container while being deflected along the rotating direction. Thus, the toner can be efficiently stirred.

SUMMARY

A developer storage container according to one aspect of the present disclosure includes a container body, a shaft body and a stirring member. The container body has a predetermined length in a first direction and includes an inner peripheral surface defining an internal space for storing developer and a developer discharge port for discharging the developer to outside. The shaft body is provided inside the container body and rotatably supported in the container body to extend in the first direction. The stirring member is made of a flexible film-like member to be attached to the shaft body and stirs the developer stored in the container body by rotating according to the rotation of the shaft body.

The stirring member includes an attaching portion and a stirring piece. The attaching portion extends in the first direction along the shaft body and serves as an area part for attachment to the shaft body. The stirring piece includes a base portion extending from the attaching portion toward the inner peripheral surface of the container body in a second direction perpendicular to the first direction and an extending portion extending from the base portion in a third direction intersecting with the second direction to approach the developer discharge port.

Further, an image forming apparatus according to another aspect of the present disclosure includes the above developer storage container, an image carrier configured such that an electrostatic latent image is formed and a developer image is carried on a surface, and a developing device configured to have the developer supplied thereto from the developer storage container and supply the developer to the image carrier.

DETAILED DESCRIPTION

<Image Forming Apparatus>

Figure 1:
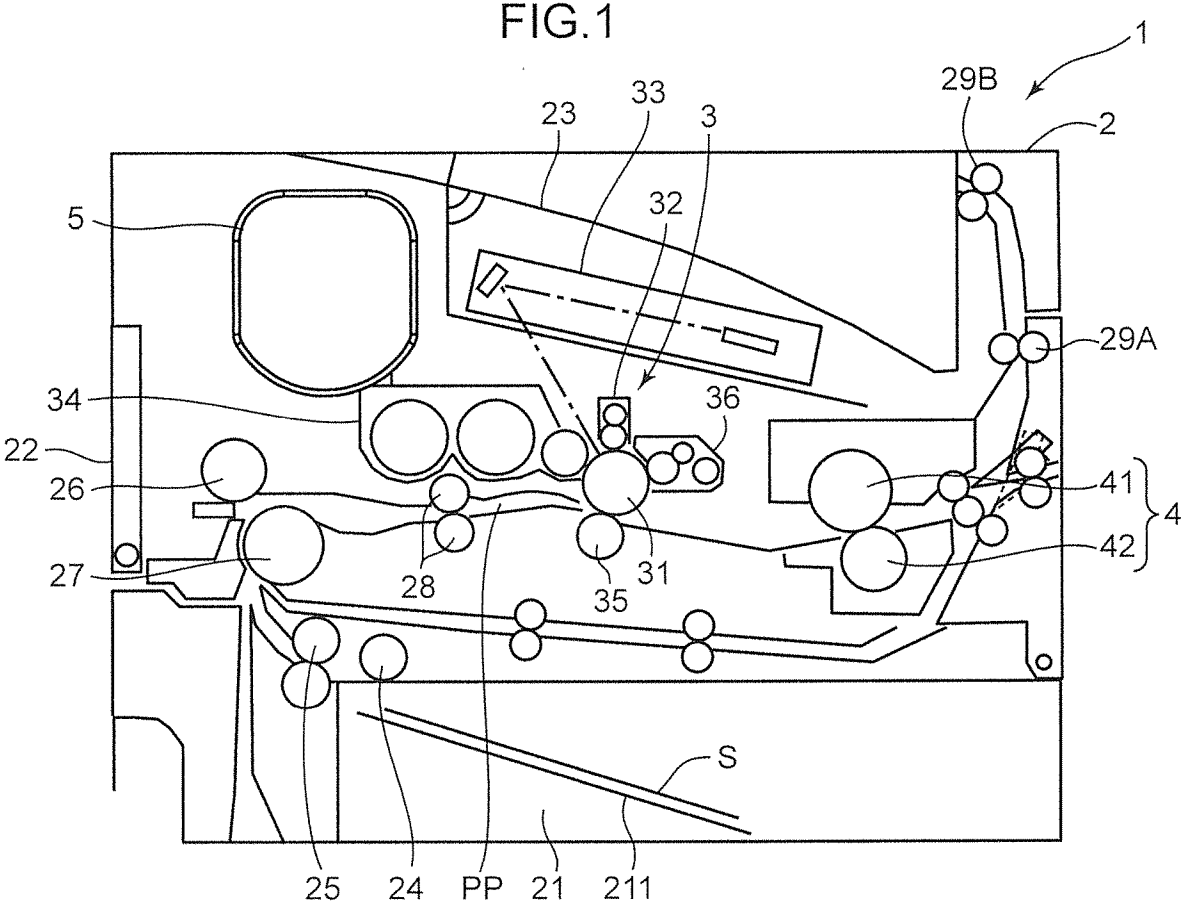
FIG. 1 is a diagram schematically showing an internal structure of an image forming apparatus according to one embodiment of the present disclosure.

Hereinafter, a developer storage container and an image forming apparatus according to one embodiment of the present disclosure are described with reference to the drawings. FIG. 1 is a diagram schematically showing an internal structure of an image forming apparatus 1 according to one embodiment of the present disclosure. The image forming apparatus 1 shown in FIG. 1 is a so-called monochrome printer of an electrophotographic type. However, in other embodiments, the image forming apparatus may be a color printer, a facsimile machine, a complex machine provided with these functions or another apparatus for forming a toner image on a sheet.

The image forming apparatus 1 includes a housing 2 for accommodating various devices for forming an image on a sheet S. A sheet conveyance path PP along which a sheet S is conveyed in a predetermined conveying direction extends in the housing 2. Further, the image forming apparatus 1 includes a cassette 21 and a manual feed tray 22 as sheet feeding units, a sheet discharge portion 23, a pickup roller 24, a first feed roller 25, a second feed roller 26, a conveyor roller 27, a pair of registration rollers 28, an image forming unit 3 and a fixing device 4.

The cassette 21 stores sheets S inside. The cassette 21 includes a lift plate 211. The lift plate 211 is inclined to push up the leading end edges of the sheets S. The cassette 21 can be pulled out forward with respect to the housing 2.

The pickup roller 24 is arranged above the leading end edges of the sheets S pushed up by the lift plate 211. When the pickup roller 24 rotates, the sheet S is pulled out from the cassette 21. The first feed roller 25 is arranged downstream of the pickup roller 24 and feeds the sheet S to a further downstream side. The second feed roller 26 pulls a sheet S on the manual feed tray 22 into the housing 2.

The conveyor roller 27 is arranged downstream of the first feed roller 25 and the second feed roller 26 in a sheet conveying direction. The conveyor roller 27 conveys the sheet S fed by the first or second feed roller 25, 26 to a further downstream side.

The pair of registration rollers 28 have a function of correcting the oblique feed of the sheet S. In this way, the position of an image to be formed on the sheet S is adjusted. The pair of registration rollers 28 supply the sheet S to the image forming unit 3 in accordance with an image formation timing by the image forming unit 3.

The image forming unit 3 includes a photoconductive drum 31 (image carrier), a charger 32, an exposure device 33, a developing device 34, a transfer roller 35, a cleaning device 36 and a toner container 5 (developer storage container).

The photoconductive drum 31 has a cylindrical shape. The photoconductive drum 31 has a surface, on which an electrostatic latent image is formed, and carries a toner image (developer image) corresponding to the electrostatic latent image on this surface. The charger 32 has a predetermined voltage applied thereto and substantially uniformly charges the surface of the photoconductive drum 31.

The exposure device 33 irradiates laser light to the surface of the photoconductive drum 31 charged by the charger 32. The laser light is irradiated in accordance with image data output from an external apparatus (not shown) such as a personal computer communicably connected to the image forming apparatus 1. As a result, an electrostatic latent image corresponding to the image data is formed on the surface of the photoconductive drum 31.

The developing device 34 supplies toner (developer) to the surface of the photoconductive drum 31 having an electrostatic latent image formed thereon. The toner container 5 supplies the toner to the developing device 34. The toner container 5 is disposed to be detachably attachable to the developing device 34. When the developing device 34 supplies the toner to the photoconductive drum 31, the electrostatic latent image formed on the surface of the photoconductive drum 31 is developed (visualized). As a result, a toner image is formed on the surface of the photoconductive drum 31.

The transfer roller 35 is arranged to face the photoconductive drum 31 across the sheet conveyance path PP below the photoconductive drum 31. A transfer nip portion is formed between the transfer roller 35 and the photoconductive drum 31, and the transfer roller 35 transfers the toner image to the sheet S. The cleaning device 36 removes the toner remaining on the surface of the photoconductive drum 31 after the toner image is transferred to the sheet S.

The fixing device 4 is arranged downstream of the image forming unit 3 in the conveying direction and fixes the toner image on the sheet S. The fixing device 4 includes a heating roller 41 for melting the toner on the sheet S and a pressure roller 42 for bringing the sheet S into close contact with the heating roller 41.

The image forming apparatus 1 further includes a pair of conveyor rollers 29A arranged downstream of the fixing device 4 and a pair of discharge rollers 29B arranged downstream of the pair of conveyor rollers 29A. The sheet S having the toner image fixed by the fixing device 4 is conveyed upwardly by the pair of conveyor rollers 29A and finally discharged from the housing 2 by the pair of discharge rollers 29B. The sheet S discharged from the housing 2 is stacked on the sheet discharge portion 23.

<Developing Device>

Figure 2:
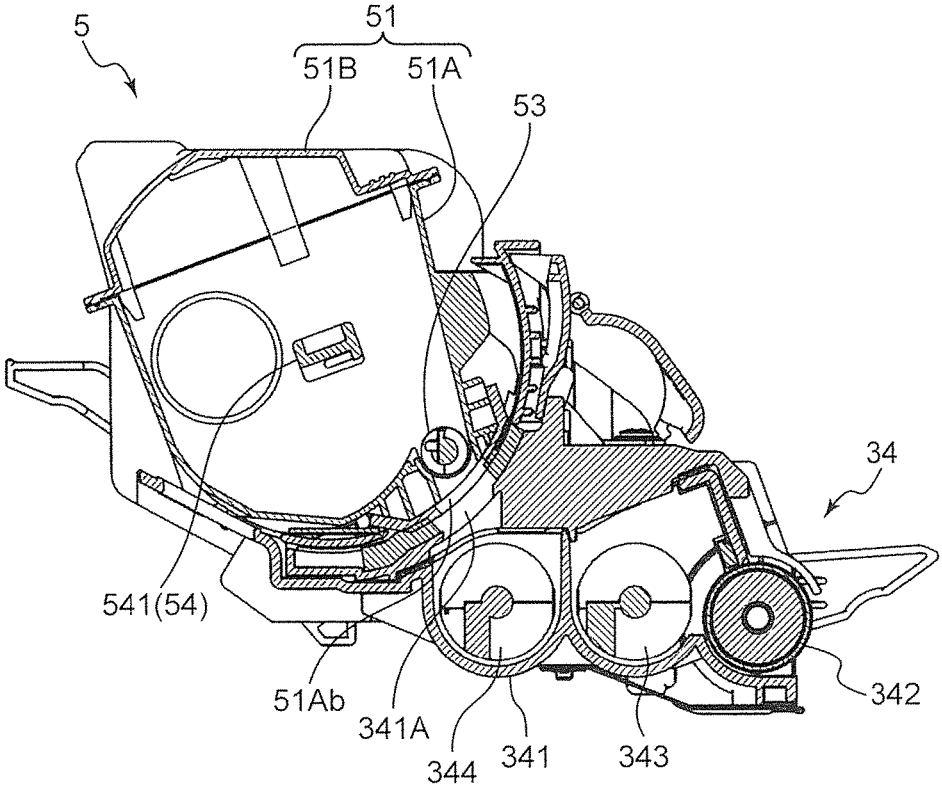
FIG. 2 is a sectional view of a developing device and a toner container provided in the image forming apparatus.

FIG. 2 is a view showing an internal structure of the developing device 34 provided in the image forming apparatus 1. The developing device 34 includes a development housing 341, a developing roller 342, a first development screw 343 and a second development screw 344.

The development housing 341 is a housing for supporting each member of the developing device 34. Further, the development housing 341 has a function of supporting the toner container 5 to be described later. Furthermore, the development housing 341 is formed with a toner supply port 341A. With the toner container 5 mounted in the development housing 341 of the developing device 34, a toner discharge port 51Ab of the toner container 5 faces the toner supply port 341A so that toner can be supplied from the toner container 5 to the developing device 34.

The developing roller 342 is rotatably supported in the development housing 341. The developing roller 342 carries developer containing toner on a peripheral surface thereof. The developing roller 342 supplies the toner to the photoconductive drum 31 to develop an electrostatic latent image on the photoconductive drum 31.

The first and second development screws 343, 344 are screws rotatably supported in the development housing 341 and having a spiral blade mounted on the peripheral surface of a shaft portion, respectively. The developer in the development housing 341 is conveyed in a circulating manner by the first and second development screws 343, 344. Further, the second development screw 344 is arranged to face the toner supply port 341A in the development housing 341. Note that the developer is supplied to the developing roller 342 by the first development screw 343.

The developing device 34 of this embodiment is configured such that a developer conveying ability of the second development screw 344 is locally reduced on a side downstream of a toner receiving area of the development housing 341. Specifically, the second development screw 344 is formed such that an outer diameter of the spiral blade is locally reduced on the side downstream of the toner receiving area of the development housing 341. Further, the second development screw 344 may be formed such that the pitches of the spiral blade are locally narrowed on the side downstream of the toner receiving area of the development housing 341. Here, the toner receiving area of the development housing 341 is an area part on the development screw 344 where the toner is supplied from the toner container 5 via the toner supply port 341A, and equivalent to an area below the toner supply port 341A.

In the developing device 34 thus configured, the developer is retained in the toner receiving area (area below the toner supply port 341A) in the development housing 341. Such retention of the developer suppresses the entrance of the toner from the toner container 5 into the development housing 341 via the toner supply port 341A.

The retained amount of the developer in the toner receiving area of the development housing 341 varies according to the amount of the developer in the development housing 341, i.e. the amount of the toner in the developer. Thus, a degree of suppression for the entrance of the toner into the development housing 341 via the toner supply port 341A varies depending on the amount of the toner in the developer in the development housing 341. If the amount of the toner in the development housing 341 decreases, the supply amount of the toner from the toner container 5 into the development housing 341 increases. Further, if the amount of the toner in the development housing 341 increases, the supply amount of the toner from the toner container 5 into the development housing 341 decreases. In this way, the supply amount of the toner from the toner container 5 into the development housing 341 is appropriately controlled.

<Toner Container>

Figure 3:
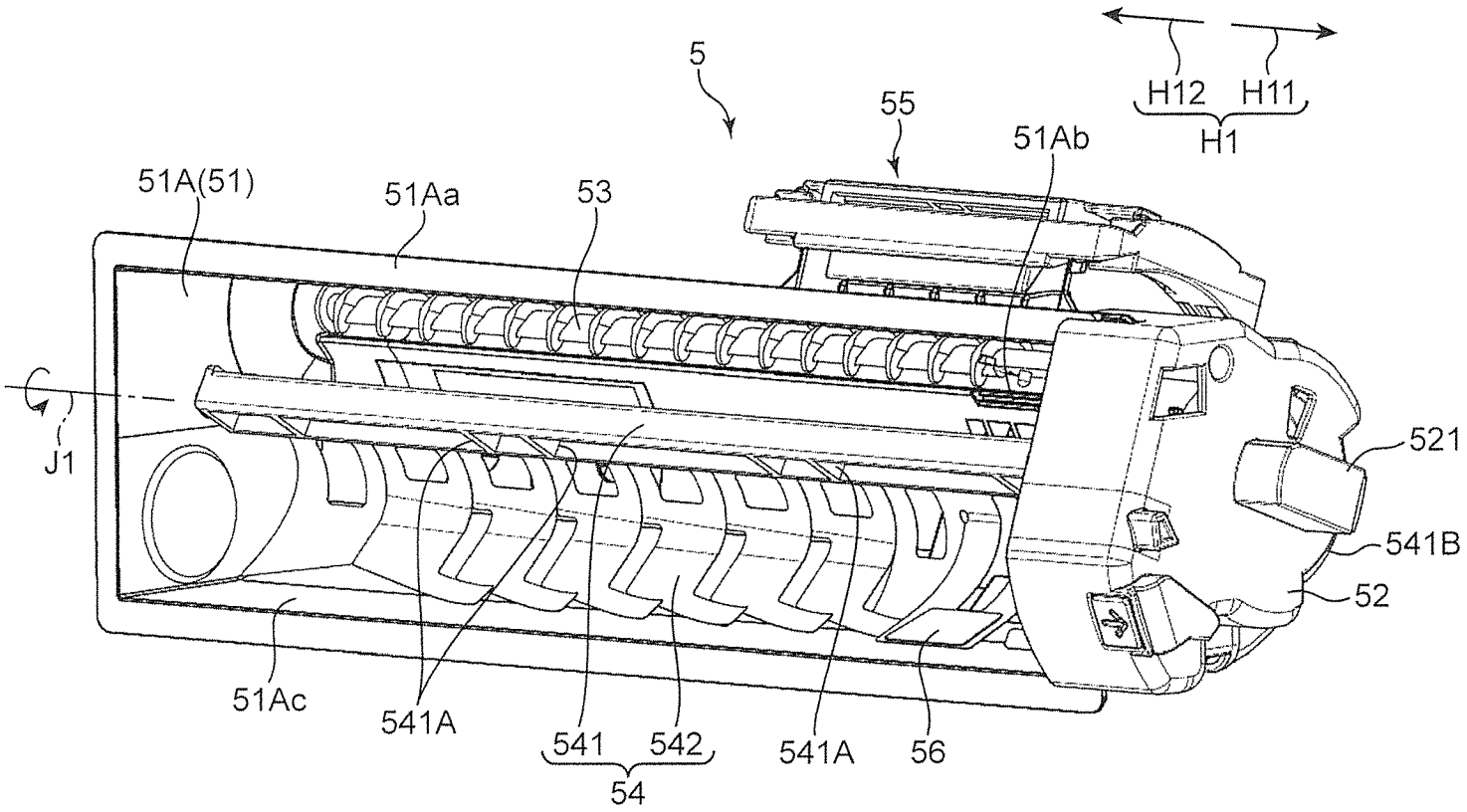
FIG. 3 is a perspective view of the toner container.
Figure 4:
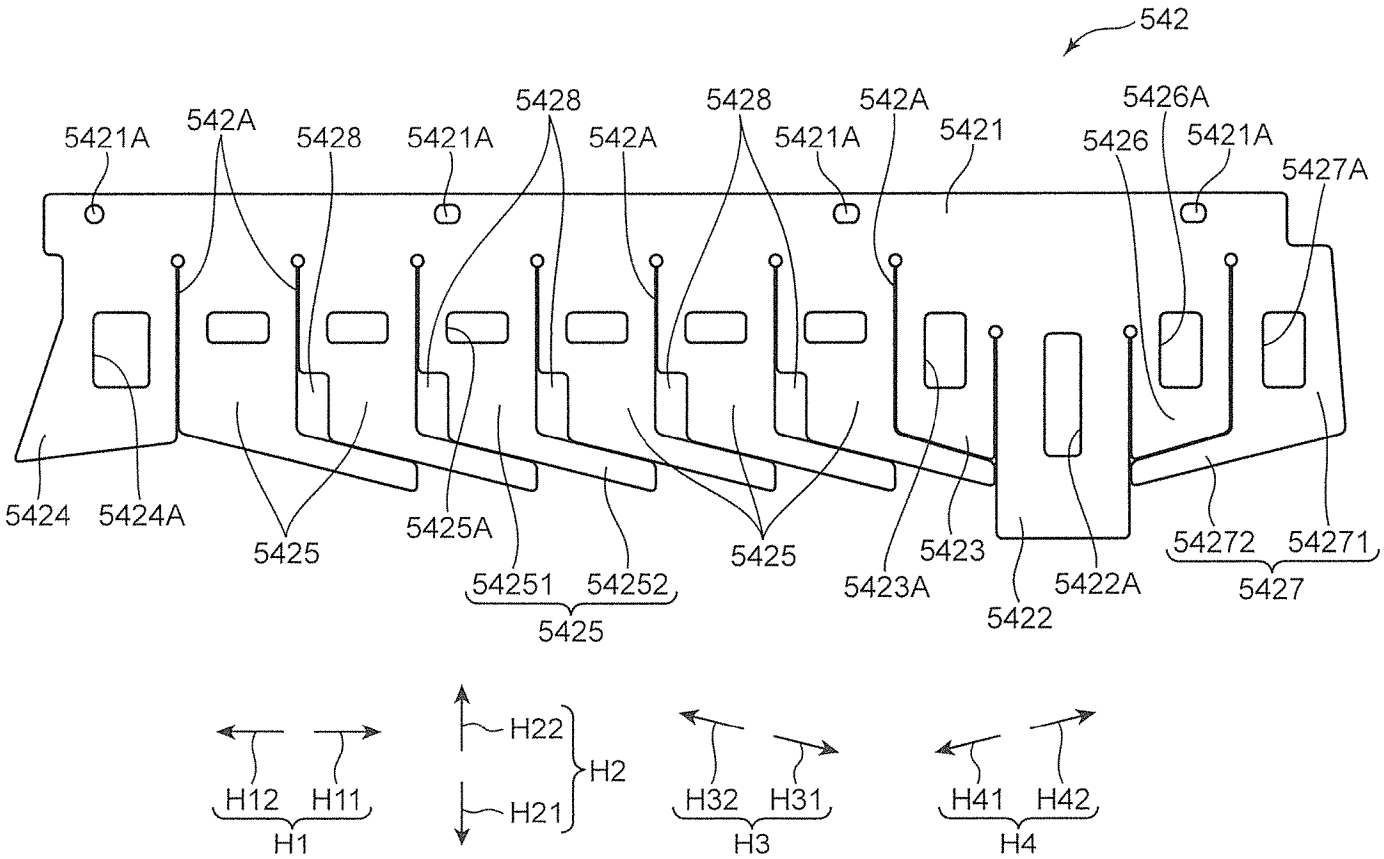
FIG. 4 is a view showing the configuration of a stirring member provided in the toner container.
Figure 5:
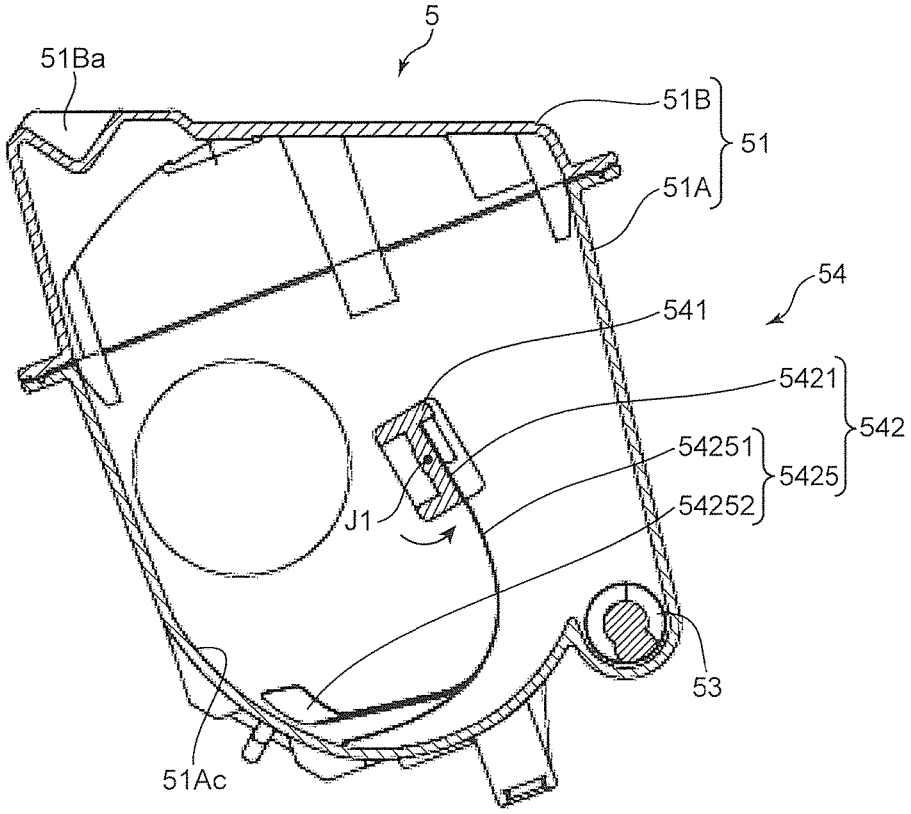
FIG. 5 is a sectional view showing a state when the stirring member rotates by a first angle in the toner container.
Figure 6:
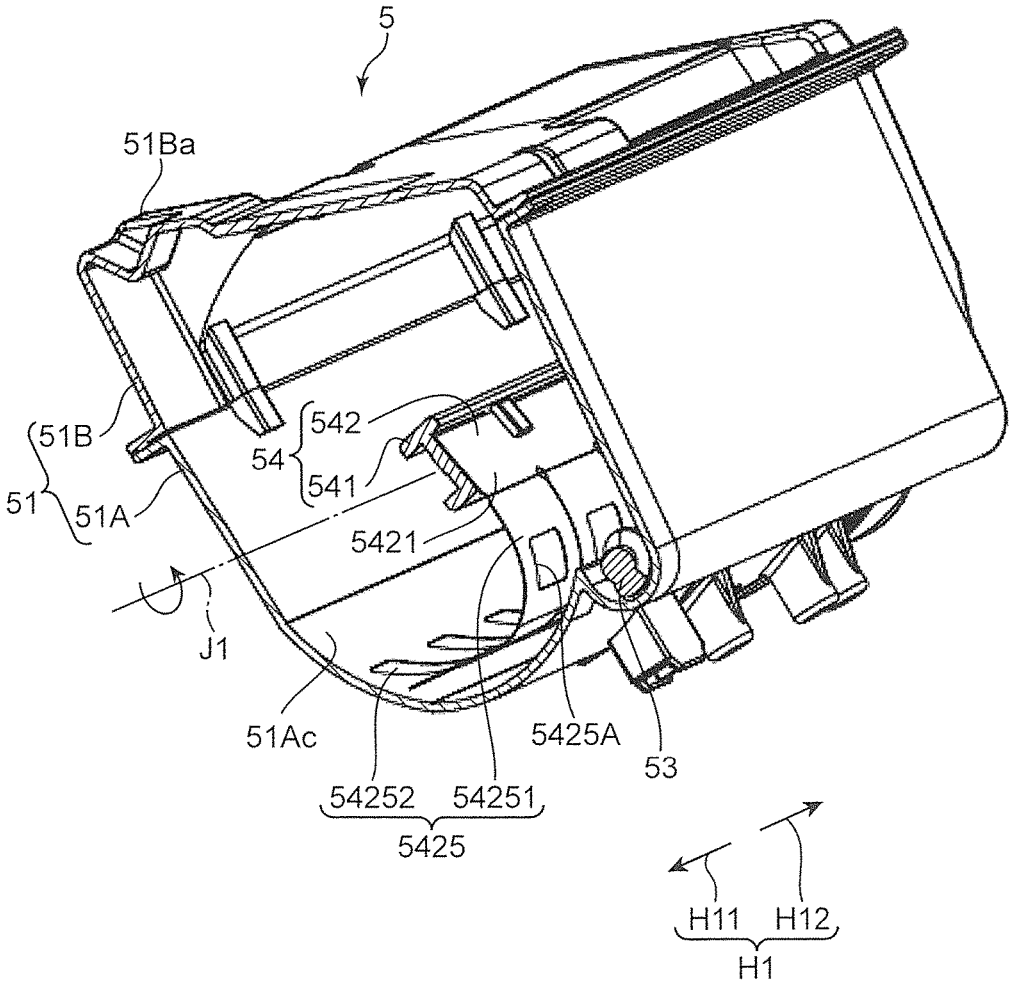
FIG. 6 is a perspective view showing the state when the stirring member rotates by the first angle.
Figure 7:
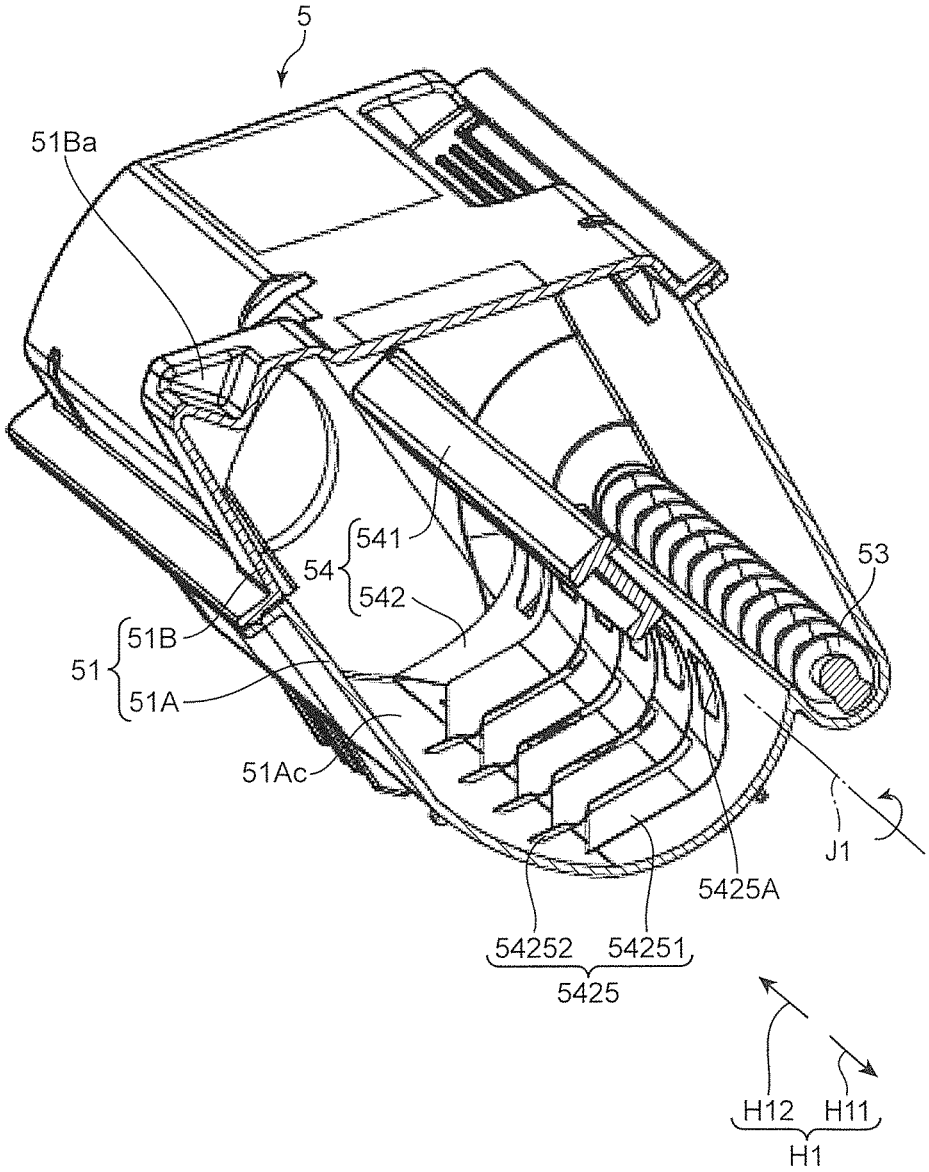
FIG. 7 is a perspective view showing the state when the stirring member rotates by the first angle.
Figure 8:
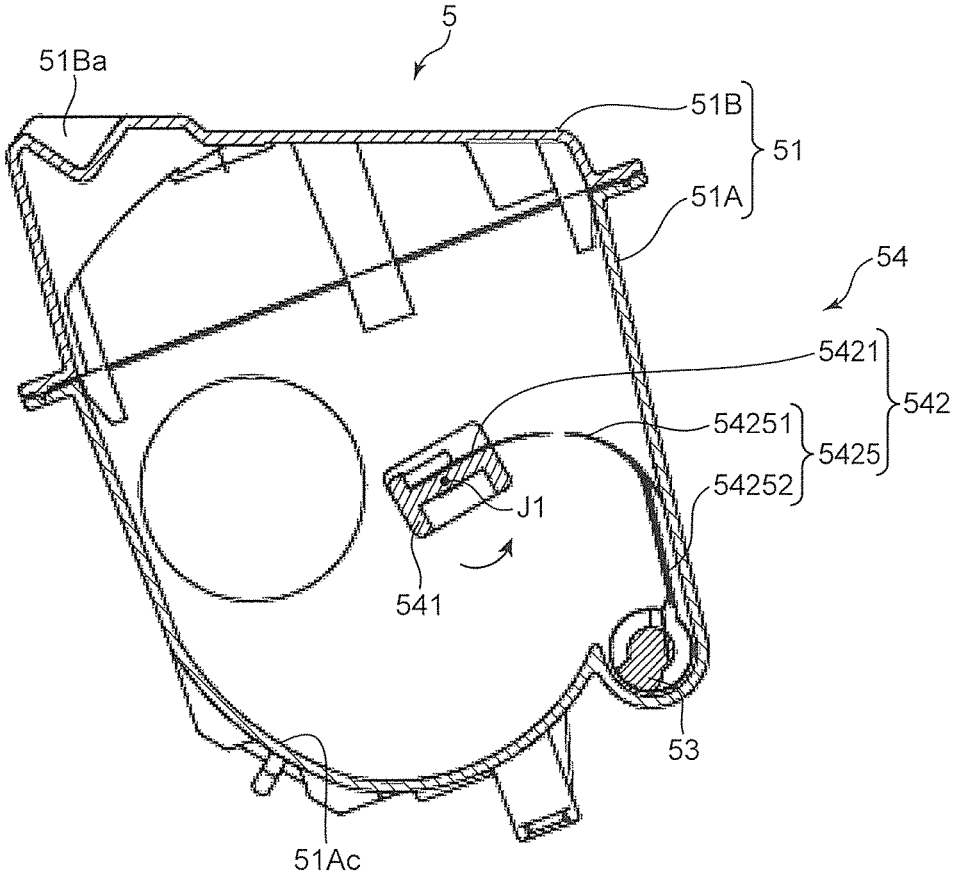
FIG. 8 is a sectional view showing a state when the stirring member rotates by a second angle.
Figure 9:
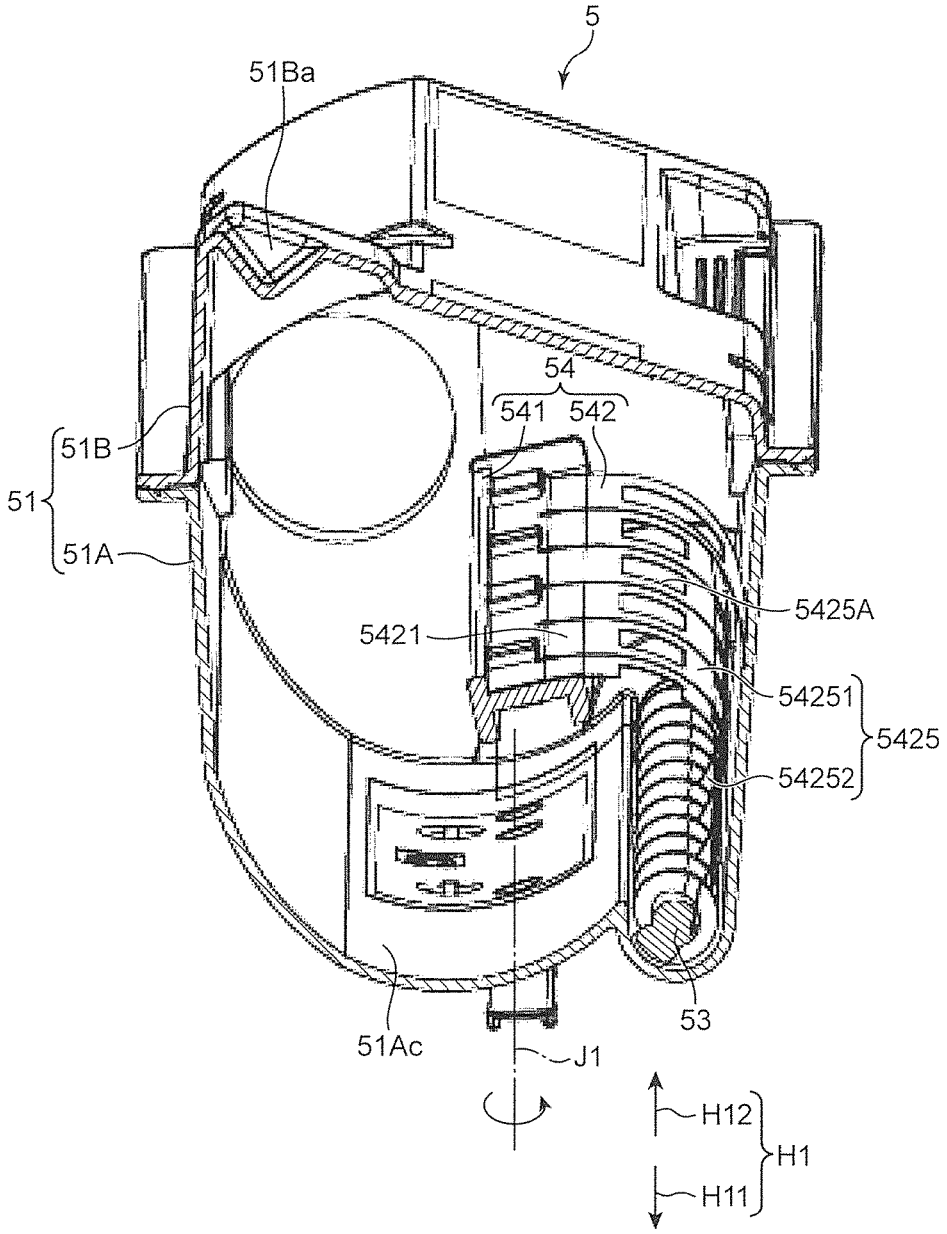
FIG. 9 is a perspective view showing the state when the stirring member rotates by the second angle.
Figure 10:
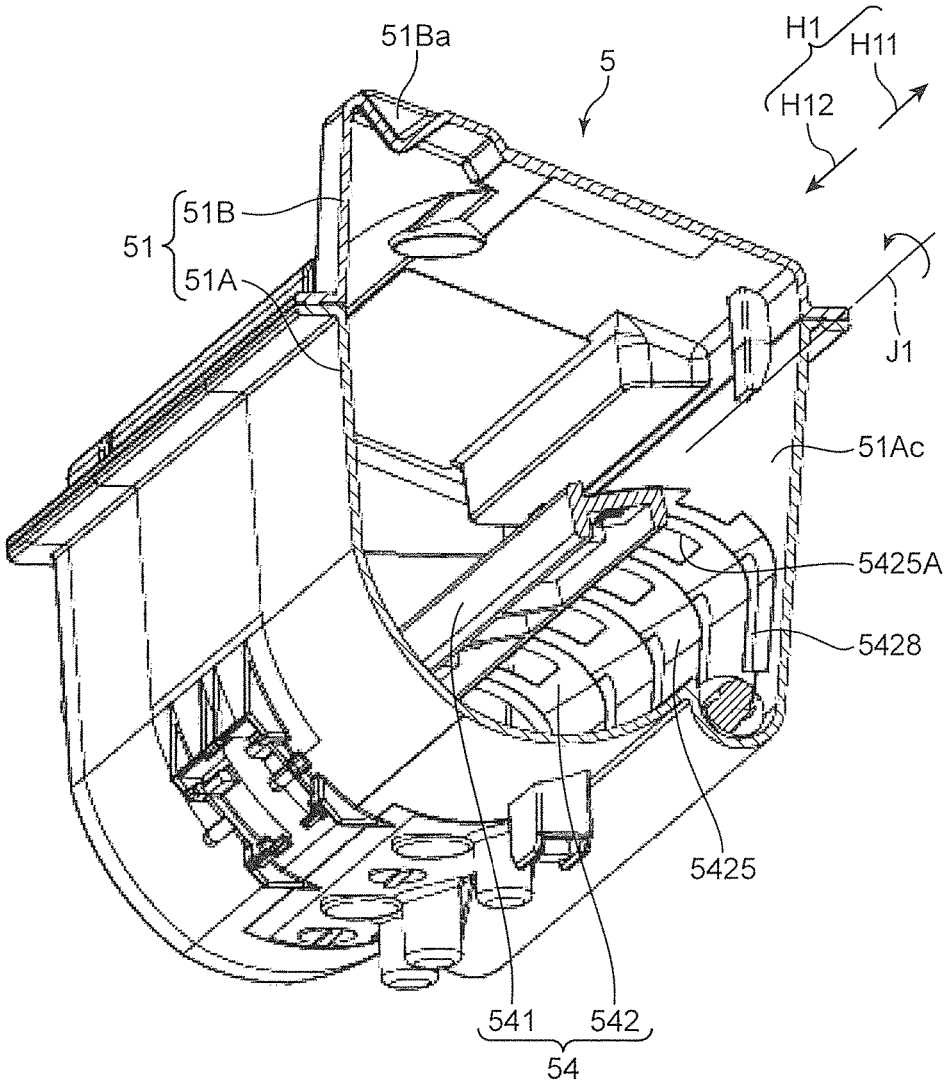
FIG. 10 is a perspective view showing the state when the stirring member rotates by the second angle.

FIG. 3 is a perspective view of the toner container 5 provided in the image forming apparatus 1. FIG. 4 is a view showing the configuration of a stirring member 542 provided in the toner container 5. FIGS. 5 to 7 are sectional views showing a state when the stirring member 542 rotates by a first angle. FIGS. 8 to 10 are sectional views showing a state when the stirring member 542 rotates by a second angle.

The toner container 5 is arranged above the toner supply port 341A of the development housing 341. The toner container 5 stores the toner inside. The toner container 5 includes a container body 51 (container body) and a container cover 52.

As shown in FIG. 3, the container body 51 has a predetermined length in a first direction H1 and is shaped to extend in this first direction H1. With the toner container 5 mounted in the development housing 341 of the developing device 34, the first direction H1 in which the container body 51 extends coincides with extending directions of the developing roller 342, the first development screw 343 and the second development screw 344 in the developing device 34. The container body 51 is configured into a container having an inner peripheral surface defining an internal space for storing the toner, and includes a body portion 51A and a lid portion 51B. Note that the lid portion 51B is removed in FIG. 3 to show an internal structure of the toner container 5.

The body portion 51A defines a lower part of the container body 51 and an upper surface part is open. Further, the toner discharge port 51Ab (developer discharge port) for discharging the toner to outside is formed in a bottom surface part of an inner peripheral surface 51Ac of the body portion 51A. In this embodiment, with the toner container 5 mounted in the development housing 341 of the developing device 34, the toner discharge port 51Ab of the toner container 5 is provided in an end part of the bottom surface part of the body portion 51A on one side H11 in the first direction H1 so as to face the toner supply port 341A of the development housing 341.

Further, as shown in FIG. 3, a shutter portion 55 is disposed in the bottom surface part of the body portion 51A to face the toner discharge port 51Ab. This shutter portion 55 is slidable with respect to the toner discharge port 51Ab. When the shutter portion 55 is slid, the toner discharge port 51Ab is opened and the toner can be discharged from the toner container 5.

The lid portion 51B is fixed to the body portion 51A to close an opening in the upper surface part of the body portion 51A. In this embodiment, the lid portion 51B is welded and fixed to the body portion 51A. At this time, the body portion 51A and the lid portion 51B are fixed at a container flange 51Aa formed along the peripheral edge of the opening in the upper surface part of the body portion 51A. The lid portion 51B includes a grip portion 51Ba. When the toner container 5 is mounted into the development housing 341 of the developing device 34, an operator can grip the grip portion 51Ba.

The container cover 52 is mounted on the end part of the container body 51 on the one side H11 in the first direction H1. The container cover 52 includes a guide portion 521. This guide portion 521 projects from the container cover 52 and guides the mounting of the toner container 5 into the development housing 341 of the developing device 34. Further, as shown in FIG. 3, the container cover 52 is provided with a transmission gear 541B for transmitting a rotational drive force to a shaft body 541 constituting a toner stirring unit 54 to be described later.

Further, the toner container 5 includes a container screw 53 and the toner stirring unit 54. The container screw 53 is a screw provided inside the container body 51 and having a spiral blade mounted on the peripheral surface of a shaft portion. The container screw 53 is rotatably supported in the body portion 51A to extend in the first direction H1 along the bottom surface part of the body portion 51A in the container body 51. The container screw 53 extends between both end parts of the container body 51 in the first direction H1 inside the container body 51. The container screw 53 conveys the toner in the container body 51 toward the toner discharge port 51Ab by being rotated.

The toner stirring unit 54 is provided inside the container body 51 and has a function of stirring the toner in the container body 51. The toner stirring unit 54 includes the shaft body 541 and a stirring member 542.

The shaft body 541 is provided inside the container body 51 and rotatably supported in the container body 51 to extend in the first direction H1. The shaft body 541 extends between the both end parts of the container body 51 in the first direction H1 in a central part inside the container body 51. Specifically, the shaft body 541 is arranged above the container screw 53 provided along the bottom surface part of the body portion 51A inside the container body 51. The shaft body 541 rotates about an axial center J1 parallel to the first direction H1 by having a rotational drive force transmitted thereto via the transmission gear 541B provided on the container cover 52.

In this embodiment, the shaft body 541 is a shaft member formed into a rectangular column and includes a plurality of through openings 541A as shown in FIG. 3. The through openings 541A penetrate in a direction perpendicular to the first direction H1 serving as an axial direction of the shaft body 541. Specifically, the shaft body 541 includes a plurality of through openings 541A penetrating in the direction perpendicular to the first direction H1. This enables a weight reduction of the shaft body 541 or a reduction of rotational load. Further, since the through openings 541A penetrate in the direction perpendicular to the first direction H1, even if the toner enters the through openings 541A when the shaft body 541 rotates in the container body 51 storing the toner, the toner is easily discharged from the through openings 541A. In this way, the accumulation of the toner in the through openings 541A is prevented to prevent the toner from being compacted into a mass in the through openings 541A.

The stirring member 542 is formed of a flexible film-like member in the form of a flat plate and attached to the shaft body 541. The stirring member 542 rotates about the axial center J1 according to the rotation of the shaft body 541, thereby stirring the toner stored in the container body 51. Examples of a constituent material of the stirring member 542 include PET (polyethylene terephthalate) resin, vinyl chloride, polycarbonate and other synthetic resins.

As shown in FIG. 4, the stirring member 542 includes an attaching portion 5421 and first to sixth stirring pieces 5422, 5423, 5424, 5425, 5426 and 5427.

The attaching portion 5421 extends in the first direction H1 along the shaft body 541 and serves as an area part for attachment to the shaft body 541. The attaching portion 5421 extends between both end parts of the shaft body 541 in the first direction H1. The attaching portion 5421 is formed with a plurality of attachment hole portions 5421A at predetermined intervals in the first direction H1. The stirring member 542 is fixed and attached to the shaft body 541 by inserting, for example, fixing members into the attachment hole portions 5421A.

The first to sixth stirring pieces 5422 to 5427 are defined by a plurality of cuts 542A extending from the attaching portion 5421 toward one side H21 in a second direction H2 perpendicular to the first direction H1. Specifically, the first to sixth stirring pieces 5422 to 5427 are arranged side by side in the first direction H1.

The first stirring piece 5422 is a piece extending from the attaching portion 5421 toward the one side H21 in the second direction H2, i.e. toward the inner peripheral surface 51Ac of the container body 51. An end part of the first stirring piece 5422 on the one side H21 is in contact with the inner peripheral surface 51Ac of the container body 51. The first stirring piece 5422 is located at the same position as the toner discharge port 51Ab formed in the body portion 51A of the container body 51 in the first direction H1. Specifically, when the stirring member 542 rotates about the axial center J1 according to the rotation of the shaft body 541, the first stirring piece 5422 contacts an area of the container screw 53 facing the toner discharge port 51Ab. When the stirring member 542 rotates about the axial center J1 according to the rotation of the shaft body 541, the first stirring piece 5422 is deflected along a rotating direction and stirs the toner stored in the container body 51 to scoop up the toner.

The first stirring piece 5422 is formed with a first opening 5422A penetrating in a thickness direction. In this way, the flexibility of the first stirring piece 5422 is enhanced to improve toner stirring performance and a rotational load can be reduced since the toner can pass through the first opening 5422A. Further, the first opening 5422A has a function of supplying the toner having passed therethrough to the container screw 53. Furthermore, as shown in FIG. 3, a conductive plate 56 (e.g. copper plate) for detecting the presence or absence of the toner in the container body 51 is arranged on the first stirring piece 5422.

The second stirring piece 5423 is a piece arranged adjacent to the first stirring piece 5422 on the other side H12 opposite to the one side H11 in the first direction H1. The second stirring piece 5423 extends from the attaching portion 5421 toward the one side H21 in the second direction H2, i.e. toward the inner peripheral surface 51Ac of the container body 51. An end part of the second stirring piece 5423 on the one side H21 is in contact with the inner peripheral surface 51Ac of the container body 51. When the stirring member 542 rotates about the axial center J1, the second stirring piece 5423 contacts the container screw 53 and stirs the toner stored in the container body 51 to scoop up the toner while being deflected along the rotating direction.

The second stirring piece 5423 is formed with a second opening 5423A penetrating in a thickness direction. In this way, the flexibility of the second stirring piece 5423 is enhanced to improve toner stirring performance and a rotational load can be reduced since the toner can pass through the second opening 5423A. Further, the second opening 5423A has a function of supplying the toner having passed therethrough to the container screw 53.

The third stirring piece 5424 is a piece extending from an end part of the attaching portion 5421 on the other side H12 in the first direction H1 toward the one side H21 in the second direction H2, i.e. toward the inner peripheral surface 51Ac of the container body 51. An end part of the third stirring piece 5424 on the one side H21 is in contact with the inner peripheral surface 51Ac of the container body 51. When the stirring member 542 rotates about the axial center J1, the third stirring piece 5424 contacts the container screw 53 and stirs the toner stored in the container body 51 to scoop up the toner while being deflected along the rotating direction.

The third stirring piece 5424 is formed with a third opening 5424A penetrating in a thickness direction. In this way, the flexibility of the third stirring piece 5424 is enhanced to improve toner stirring performance and a rotational load can be reduced since the toner can pass through the third opening 5424A. Further, the third opening 5424A has a function of supplying the toner having passed therethrough to the container screw 53.

The fourth stirring piece 5425 is a piece arranged between the second and third stirring pieces 5423, 5424. The fourth stirring piece 5425 includes a base portion 54251 and an extending portion 54252. In the fourth stirring piece 5425, the base portion 54251 extends from the attaching portion 5421 toward the one side H21 in the second direction H2, i.e. toward the inner peripheral surface 51Ac of the container body 51. An end part of the base portion 54251 on the one side H21 is in contact with the inner peripheral surface 51Ac of the container body 51.

In the fourth stirring piece 5425, the extending portion 54252 extends from an end part of the base portion 54251 on the one side H21 toward one side H31 in a third direction H3 intersecting with the second direction H2 to approach the toner discharge port 51Ab. Specifically, the extending portion 54252 extends from the end part of the base portion 54251 on the one side H21 toward the one side H31, i.e. toward the first stirring piece 5422. This extending portion 54252 is in contact with the inner peripheral surface 51Ac of the container body 51.

In this embodiment, the third direction H3, which is an extending direction of the extending portion 54252 with respect to the base portion 54251, is inclined with respect to a direction perpendicular to the second direction H2. That is, the third direction H3 is inclined toward the one side H31 on the one side H21 in the second direction H2 with respect to the second direction H2. Specifically, the extending portion 54252 extends from the base portion 54251 to be inclined toward the one side H21 with respect to the direction perpendicular to the second direction H2 from the end part on a side H32 opposite to the one side H31 toward the end part on the one side H31. Note that the third direction H3 is roughly the same direction as the first direction H1, but is inclined with respect to the first direction H1.

The base portion 54251 is formed to extend from the attaching portion 5421 toward the one side H21 in the second direction H2, i.e. toward the inner peripheral surface 51Ac of the container body 51. Thus, when the stirring member 542 rotates about the axial center J1, the base portion 54251 contacts the container screw 53 and stirs the toner stored in the container body 51 to scoop up the toner while being deflected along the rotating direction (see FIGS. 5 to 10). In this way, the toner can be efficiently stirred.

Further, the extending portion 54252 extends from the base portion 54251 toward the one side H31 in the third direction H3 to approach the toner discharge port 51Ab. Thus, when the stirring member 542 rotates about the axial center J1, the extending portion 54252 is deflected to swing in a direction intersecting with the rotating direction with a contact part with the base portion 54251 as a center (see FIGS. 5 to 10). Thus, when the stirring member 542 rotates, the extending portion 54252 applies a conveying force to the toner stored in the container body 51 so that the toner approaches the toner discharge port 51Ab. As a result, even if the remaining amount of the toner in the container body 51 has decreased, the toner stored in the container body 51 can be collected near the toner discharge port 51A on the container screw 53 while being stirred by the rotation of the stirring member 542. Thus, even if the remaining amount of the toner in the container body 51 has decreased, a decrease of the accumulated amount of the toner near the toner discharge port 51Ab on the container screw 53 can be suppressed and a reduction of the toner supply amount from the toner discharge port 51Ab to the developing device 34 via the container screw 53 can be suppressed.

Further, as shown in FIG. 4, a plurality of fourth stirring pieces 5425 are arranged side by side in the first direction H1. In a relationship between the fourth stirring piece 5425 (one stirring piece) on the one side H11 and the fourth stirring piece 5425 on the other side H12 adjacent to each other, the base portion 54251 of the fourth stirring piece 5425 on the one side H11 and the extending portion 54252 of the fourth stirring piece 5425 on the other side H12 are arranged in the second direction H2. Of course, the extending portion 54252 is arranged on the one side H21 and the base portion 54251 is arranged on a side H22 opposite the one side H21. The fourth stirring pieces 5425 have a function of conveying the toner stored in the container body 51 in a direction toward the toner discharge port 51Ab while stirring the toner. By arranging the plurality of fourth stirring pieces 5425 having such a function, stirring property and conveying property for the toner can be improved.

The base portion 54251 of the fourth stirring piece 5425 is formed with a fourth opening 5425A penetrating in a thickness direction. In this way, the flexibility of the fourth stirring piece 5425 is enhanced to improve toner stirring performance and a rotational load can be reduced since the toner can pass through the fourth opening 5425A. Further, the fourth opening 5425A has a function of supplying the toner having passed therethrough to the container screw 53.

Further, in this embodiment, the stirring member 542 includes clearances 5428 formed between the fourth stirring pieces 5425 adjacent to each other. The clearances 5428 are formed on the other side H22 in the second direction H2 of the extending portions 54252 of at least some of the plurality of fourth stirring pieces 5425. In other words, the clearances 5428 are at least partially defined by the extending portions 54252 of at least some of the plurality of fourth stirring pieces 5425.

When the stirring member 542 rotates, part of the toner present on a side downstream of the stirring member 542 in the rotating direction in the container body 51 passes through the clearances 5428 and appears on a surface of the stirring member 542. Here, the clearances 5428 are at least partially defined by the extending portions 54252 of the fourth stirring pieces 5425. Thus, the toner having passed through these clearances 5428 can be efficiently conveyed in the direction toward the toner discharge port 51Ab by the extending portions 54252. As a result, even if the remaining amount of the toner in the container body 51 has decreased, a decrease of the accumulated amount of the toner near the toner discharge port 51Ab on the container screw 53 can be suppressed and a reduction of the toner supply amount from the toner discharge port 51Ab to the developing device 34 via the container screw 53 can be suppressed.

The fifth stirring piece 5426 is a piece arranged adjacent to the first stirring piece 5422 on the one side H11 in the first direction H1. The fifth stirring piece 5426 extends from the attaching portion 5421 toward the one side H21 in the second direction H2, i.e. toward the inner peripheral surface 51Ac of the container body 51. An end part of the fifth stirring piece 5426 on the one side H21 is in contact with the inner peripheral surface 51Ac of the container body 51. When the stirring member 542 rotates about the axial center J1 according to the rotation of the shaft body 541, the fifth stirring piece 5426 contacts the container screw 53 and stirs the toner stored in the container body 51 to scoop up the toner while being deflected along the rotating direction.

The fifth stirring piece 5426 is formed with a fifth opening 5426A penetrating in a thickness direction. In this way, the flexibility of the fifth stirring piece 5426 is enhanced to improve toner stirring performance and a rotational load can be reduced since the toner can pass through the fifth opening 5426A. Further, the fifth opening 5426A has a function of supplying the toner having passed therethrough to the container screw 53.

The sixth stirring piece 5427 is a piece arranged adjacent to the fifth stirring piece 5426 on the one side H11 in the first direction H1. The sixth stirring piece 5427 includes a base portion 54271 and an extending portion 54272. The base portion 54271 extends from the attaching portion 5421 toward the one side H21 in the second direction H2, i.e. toward the inner peripheral surface 51Ac of the container body 51. An end part of the base portion 54271 on the one side H21 is in contact with the inner peripheral surface 51Ac of the container body 51.

The extending portion 54272 extends from an end part of the base portion 54271 on the one side H21 toward one side H41 in a fourth direction H4 intersecting with the second direction H2 to approach the toner discharge port 51Ab. Specifically, the extending portion 54272 extends from the end part of the base portion 54271 on the one side H21 toward the one side H41, i.e. toward the first stirring piece 5422. This extending portion 54272 is in contact with the inner peripheral surface 51Ac of the container body 51. In this embodiment, the fourth direction H4, which is an extending direction of the extending portion 54272 with respect to the base portion 54271, is a direction inclined toward the one side H21 with respect to the second direction H2 toward the one side H41. Specifically, the extending portion 54272 extends from the base portion 54271 to be inclined toward the one side H21 from the end part on a side H42 opposite to the one side H41 in the fourth direction H4 toward the end part on the one side H41.

The base portion 54271 is formed to extend from the attaching portion 5421 toward the one side H21, i.e. toward the inner peripheral surface 51Ac of the container body 51. Thus, when the stirring member 542 rotates about the axial center J1, the base portion 54271 contacts the container screw 53 and stirs the toner stored in the container body 51 to scoop up the toner while being deflected along the rotating direction. In this way, the toner can be efficiently stirred.

Further, the extending portion 54272 extends from the base portion 54271 toward the one side H41 in the fourth direction H4 to approach the toner discharge port 51Ab. Thus, when the stirring member 542 rotates about the axial center J1, the extending portion 54272 is deflected to swing in a direction intersecting with the rotating direction with a contact part with the base portion 54271 as a center. Thus, when the stirring member 542 rotates, the extending portion 54272 applies a conveying force to the toner stored in the container body 51 so that the toner approaches the toner discharge port 51Ab. As a result, even if the remaining amount of the toner in the container body 51 has decreased, the toner stored in the container body 51 can be collected near the toner discharge port 51A on the container screw 53 while being stirred by the rotation of the stirring member 542. Thus, even if the remaining amount of the toner in the container body 51 has decreased, a decrease of the accumulated amount of the toner near the toner discharge port 51Ab on the container screw 53 can be suppressed and a reduction of the toner supply amount from the toner discharge port 51Ab to the developing device 34 via the container screw 53 can be suppressed.

Further, the base portion 54271 is formed with a sixth opening 5427A penetrating in a thickness direction. In this way, the flexibility of the sixth stirring piece 5427 is enhanced to improve toner stirring performance and a rotational load can be reduced since the toner can pass through the sixth opening 5427A. Further, the sixth opening 5427A has a function of supplying the toner having passed therethrough to the container screw 53.

<Modification of Stirring Member>

Figure 11:
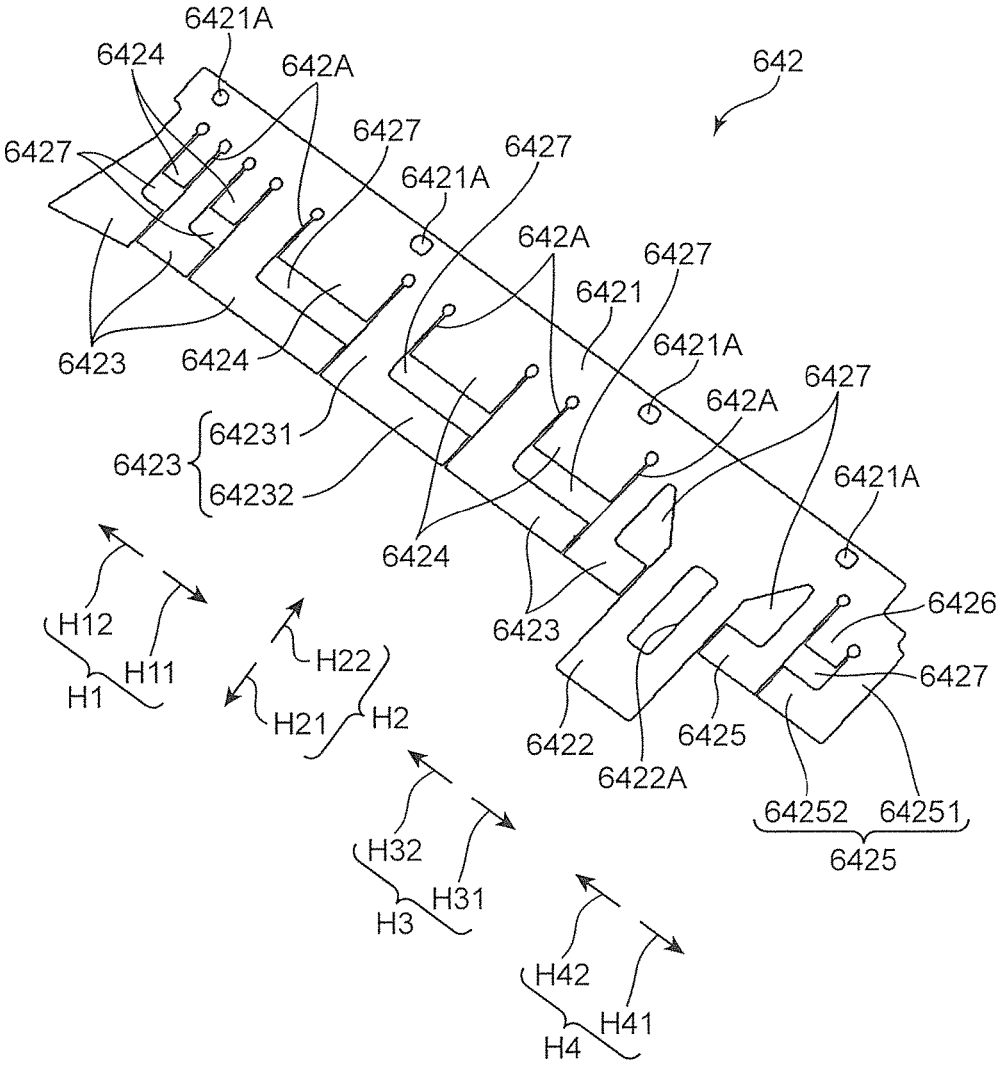
FIG. 11 is a view showing a modification of the stirring member provided in the toner container.

FIG. 11 is a view showing a stirring member 642 as a modification of the stirring member provided in the toner container 5. The stirring member 642 is made of a flexible film-like member in the form of a flat plate similarly to the above stirring member 542, and attached to the shaft body 541. The stirring member 642 rotates about the axial center J1 according to the rotation of the shaft body 541, thereby stirring the toner stored in the container body 51.

The stirring member 642 includes an attaching portion 6421 and first to fifth stirring pieces 6422, 6423, 6424, 6425 and 6426.

The attaching portion 6421 extends in a first direction H1 along the shaft body 541 and serves as an area part for attachment to the shaft body 541. The attaching portion 6421 extends between both end parts of the shaft body 541 in the first direction H1. The attaching portion 6421 is formed with a plurality of attachment hole portions 6421A penetrating in a thickness direction and arranged at predetermined intervals in the first direction H1. The stirring member 642 is fixed and attached to the shaft body 541 by inserting, for example, fixing members into the attachment hole portions 6421A.

In the stirring member 642, the first to fifth stirring pieces 6422 to 6426 are defined by a plurality of cuts 642A extending from the attaching portion 6421 toward one side H21 in a second direction H2. Specifically, the first to fifth stirring pieces 6422 to 6426 are arranged side by side in the first direction H1.

The first stirring piece 6422 is a piece extending from the attaching portion 6421 toward the one side H21 in the second direction H2, i.e. toward the inner peripheral surface 51Ac of the container body 51. An end part of the first stirring piece 6422 on the one side H21 is in contact with the inner peripheral surface 51Ac of the container body 51. The first stirring piece 6422 is located at the same position as the toner discharge port 51Ab formed in the body portion 51A of the container body 51 in the first direction H1. Specifically, when the stirring member 642 rotates about the axial center J1, the first stirring piece 6422 contacts an area of the container screw 53 facing the toner discharge port 51Ab. When the stirring member 642 rotates about the axial center J1, the first stirring piece 6422 is deflected along a rotating direction and stirs the toner stored in the container body 51 to scoop up the toner.

The first stirring piece 6422 is formed with a first opening 6422A penetrating in a thickness direction. In this way, the flexibility of the first stirring piece 6422 is enhanced to improve toner stirring performance and a rotational load can be reduced since the toner can pass through the first opening 6422A. Further, the first opening 6422A has a function of supplying the toner having passed therethrough to the container screw 53.

The second stirring piece 6423 is a piece arranged on a side H12 in the first direction H1 with respect to the first stirring piece 6422, where the side H12 is opposite the one side H11. The second stirring piece 6423 includes a base portion 64231 and an extending portion 64232. The base portion 64231 extends from the attaching portion 6421 toward the one side H21 in the second direction H2, i.e. toward the inner peripheral surface 51Ac of the container body 51. An end part of the base portion 64231 on the one side H21 is in contact with the inner peripheral surface 51Ac of the container body 51.

The extending portion 64232 extends from an end part of the base portion 64231 on the one side H21 toward one side H31 in a third direction H3 to approach the toner discharge port 51Ab. Specifically, the extending portion 64232 extends from the end part of the base portion 64231 on the one side H21 toward the one side H31, i.e. toward the first stirring piece 6422. This extending portion 64232 is in contact with the inner peripheral surface 51Ac of the container body 51. In this modification, the third direction H3, which is an extending direction of the extending portion 64232 with respect to the base portion 64231, coincides with the first direction H1 perpendicular to the second direction H2.

The base portion 64231 is formed to extend from the attaching portion 6421 toward the one side H21 in the second direction H2, i.e. toward the inner peripheral surface 51Ac of the container body 51. Thus, when the stirring member 642 rotates about the axial center J1, the base portion 64231 contacts the container screw 53 and stirs the toner stored in the container body 51 to scoop up the toner while being deflected along the rotating direction. In this way, the toner can be efficiently stirred.

Further, the extending portion 64232 extends from the base portion 64231 toward the one side H31 in the third direction H3 to approach the toner discharge port 51Ab. Thus, when the stirring member 642 rotates about the axial center J1, the extending portion 64232 is deflected to swing in a direction intersecting with the rotating direction with a contact part with the base portion 64231 as a center. Thus, when the stirring member 642 rotates, the extending portion 64232 applies a conveying force to the toner stored in the container body 51 so that the toner approaches the toner discharge port 51Ab. As a result, even if the remaining amount of the toner in the container body 51 has decreased, the toner stored in the container body 51 can be collected near the toner discharge port 51A on the container screw 53 while being stirred by the rotation of the stirring member 642. Thus, even if the remaining amount of the toner in the container body 51 has decreased, a decrease of the accumulated amount of the toner near the toner discharge port 51Ab on the container screw 53 can be suppressed and a reduction of the toner supply amount from the toner discharge port 51Ab to the developing device 34 via the container screw 53 can be suppressed.

Further, as shown in FIG. 11, a plurality of second stirring pieces 6423 are arranged side by side in the first direction H1. As described above, the second stirring pieces 6423 have a function of conveying the toner stored in the container body 51 in a direction toward the toner discharge port 51Ab while stirring the toner. By arranging the plurality of second stirring pieces 6423 having such a function, stirring property and conveying property for the toner can be improved.

The third stirring piece 6424 is a piece formed between the second stirring pieces 6423 adjacent to each other. The third stirring piece 6424 extends from the attaching portion 6421 toward the one side H21 in the second direction H2 to form a clearance 6427 between the second stirring pieces 6423 adjacent to each other. Specifically, the clearance 6427 is formed on a side H22 in the second direction H2 of the extending portion 64232 of each of the plurality of second stirring pieces 6423, where the side H22 is opposite the side H21. In other words, the clearances 6427 are at least partially defined by the respective extending portions 64232 of the plurality of second stirring pieces 6423.

When the stirring member 642 rotates, part of the toner present on a side downstream of the stirring member 642 in the rotating direction in the container body 51 passes through the clearances 6427 and appears on the surface of the stirring member 642. Here, the clearances 6427 are at least partially defined by the extending portions 64232. Thus, the toner having passed through the clearances 6427 can be efficiently conveyed in the direction toward the toner discharge port 51Ab by the extending portions 64232. As a result, even if the remaining amount of the toner in the container body 51 has decreased, a decrease of the accumulated amount of the toner near the toner discharge port 51Ab can be suppressed and a reduction of the toner supply amount to the developing device 34 can be suppressed.

The fourth stirring piece 6425 is a piece arranged on one side H11 in the first direction H1 with respect to the first stirring piece 6422. The fourth stirring piece 6425 includes a base portion 64251 and an extending portion 64252. The base portion 64251 extends from the attaching portion 6421 toward the one side H21 in the second direction H2, i.e. toward the inner peripheral surface 51Ac of the container body 51. An end part of the base portion 64251 on the one side H21 is in contact with the inner peripheral surface 51Ac of the container body 51.

The extending portion 64252 extends from an end part of the base portion 64251 on the one side H21 toward one side H41 in a fourth direction H4 to approach the toner discharge port 51Ab. Specifically, the extending portion 64252 extends from the end part of the base portion 64251 on the one side H21 toward the one side H41, i.e. toward the first stirring piece 6422. This extending portion 64252 is in contact with the inner peripheral surface 51Ac of the container body 51. In this embodiment, the fourth direction H4, which is an extending direction of the extending portion 64252 with respect to the base portion 64251, coincides with the first direction H1 perpendicular to the second direction H2.

The base portion 64251 is formed to extend from the attaching portion 6421 toward the one side H21 in the second direction H2, i.e. toward the inner peripheral surface 51Ac of the container body 51. Thus, when the stirring member 642 rotates about the axial center J1, the base portion 64251 contacts the container screw 53 and stirs the toner stored in the container body 51 to scoop up the toner while being deflected along the rotating direction. In this way, the toner can be efficiently stirred.

Further, the extending portion 64252 extends from the base portion 64251 toward the one side H41 in the fourth direction H4 to approach the toner discharge port 51Ab. Thus, when the stirring member 642 rotates about the axial center J1, the extending portion 64252 is deflected to swing in a direction intersecting with the rotating direction with a contact part with the base portion 64251 as a center. Thus, when the stirring member 642 rotates, the extending portion 64252 applies a conveying force to the toner stored in the container body 51 so that the toner approaches the toner discharge port 51Ab. As a result, even if the remaining amount of the toner in the container body 51 has decreased, the toner stored in the container body 51 can be collected near the toner discharge port 51A on the container screw 53 while being stirred by the rotation of the stirring member 642. Thus, even if the remaining amount of the toner in the container body 51 has decreased, a decrease of the accumulated amount of the toner near the toner discharge port 51Ab on the container screw 53 can be suppressed and a reduction of the toner supply amount from the toner discharge port 51Ab to the developing device 34 via the container screw 53 can be suppressed.

Further, as shown in FIG. 11, a plurality of fourth stirring pieces 6425 are arranged side by side in the first direction H1 in the stirring member 642.

The fifth stirring piece 6426 is a piece formed between the fourth stirring pieces 6425 adjacent to each other. The fifth stirring piece 6426 extends from the attaching portion 6421 toward the one side H21 in the second direction H2 to form a clearance 6427 between the fourth stirring pieces 6425 adjacent to each other. Specifically, the clearance 6427 is formed on the other side H22 in the second direction H2 of the extending portion 64252 of each of the plurality of fourth stirring pieces 6425. In other words, the clearances 6427 are at least partially defined by the respective extending portions 64252 of the plurality of fourth stirring pieces 6425.

When the stirring member 642 rotates, part of the toner present on the side downstream of the stirring member 642 in the rotating direction in the container body 51 passes through the clearances 6427 and appears on the surface of the stirring member 642. Here, the clearances 6427 are defined by the extending portions 64252 of the fourth stirring pieces 6425. Thus, the toner having passed through the clearances 6427 can be efficiently conveyed in the direction toward the toner discharge port 51Ab by the extending portions 64252 of the fourth stirring pieces 6425.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A developer storage container, comprising:

a container body having a predetermined length in a first direction and including an inner peripheral surface defining an internal space for storing developer and a developer discharge port for discharging the developer to outside;

a shaft body provided inside the container body and rotatably supported in the container body to extend in the first direction; and a stirring member made of a flexible film-like member to be attached to the shaft body and configured to stir the developer stored in the container body by rotating according to the rotation of the shaft body;

wherein the stirring member includes:

an attaching portion extending in the first direction along the shaft body and serving as an area part for attachment to the shaft body; and a plurality of stirring pieces arranged side by side in the first direction, each of the stirring pieces including a base portion extending from the attaching portion toward the inner peripheral surface of the container body in a second direction perpendicular to the first direction and an extending portion extending from the base portion in a third direction intersecting with the second direction to approach the developer discharge port, the plurality of stirring pieces including first and second stirring pieces that have base portions adjacent to one another in the first direction, the base portion of the first stirring piece and the extending portion of the second stirring piece being arranged with respect to one another in the second direction.

2. A developer storage container according to claim 1, wherein:

the stirring member includes a clearance formed between the stirring pieces adjacent to each other; and the clearance is at least partially defined by the extending portions of at least some of the plurality of stirring pieces.

3. A developer storage container according to claim 1, wherein:

the third direction in which the extending portion extends is inclined with respect to a direction perpendicular to the second direction.

4. An image forming apparatus, comprising:

a developer storage container according to claim 1;

an image carrier configured such that an electrostatic latent image is formed and a developer image is carried on a surface; and a developing device configured to have the developer supplied thereto from the developer storage container and supply the developer to the image carrier.

5. A developer storage container according to claim 1, wherein:

the stirring member further includes a piece extending linearly in the second direction toward the inner peripheral surface at a position facing the toner discharge port and having an end part in contact with the inner peripheral surface.

* * * * *